US010436502B2

(12) United States Patent
Claass et al.

(10) Patent No.: US 10,436,502 B2
(45) Date of Patent: Oct. 8, 2019

(54) DOOR SHELF FOR A REFRIGERATION DEVICE, REFRIGERATION DEVICE HAVING A DOOR SHELF AND METHOD FOR PROVIDING A DOOR SHELF

(71) Applicant: BSH HAUSGERAETE GMBH, Munich (DE)

(72) Inventors: Elena Claass, Geislingen (DE); Denis Lux, Heidenheim (DE); Andrea Fink, Gerstetten (DE); Stefan Deissler, Noerdlingen (DE)

(73) Assignee: BSH Hausgeraete GmbH, Munich (DE)

( * ) Notice: Subject to any disclaimer, the term of this patent is extended or adjusted under 35 U.S.C. 154(b) by 0 days.

(21) Appl. No.: 16/131,273

(22) Filed: Sep. 14, 2018

(65) Prior Publication Data

US 2019/0078836 A1 Mar. 14, 2019

(30) Foreign Application Priority Data

Sep. 14, 2017 (DE) ..... 10 2017 216 288

(51) Int. Cl.
*F25D 25/02* (2006.01)
*F25D 23/04* (2006.01)

(52) U.S. Cl.
CPC ..... *F25D 25/02* (2013.01); *F25D 23/04* (2013.01)

(58) Field of Classification Search
CPC ..... F25D 25/02; F25D 23/028; F25D 23/04; F25D 2323/02
See application file for complete search history.

(56) References Cited

U.S. PATENT DOCUMENTS 8,342,619 B2 * 1/2013 Seo ..... F25D 25/04 312/247
2010/0031690 A1 * 2/2010 Becke ..... F25D 23/04 62/377
2012/0018435 A1 * 1/2012 Kim ..... F25D 23/04 220/592.02
2012/0293056 A1 * 11/2012 Kim ..... F25D 23/04 312/405.1
2019/0041121 A1 * 2/2019 Bento ..... F25D 23/04

FOREIGN PATENT DOCUMENTS

DE 102012008596 A1 10/2013

* cited by examiner

*Primary Examiner* — Daniel J Rohrhoff
(74) *Attorney, Agent, or Firm* — Laurence A. Greenberg; Werner H. Stemer; Ralph E. Locher

(57) ABSTRACT

A door shelf for a refrigeration device includes a base. A support frame on the base defines a front and two side portions, each side portion includes front, central and rear side portions, the rear side portion is offset inwardly to the front side portion and the central side portion includes a first end at the front side portion. A preferably metal decorative strip which includes front, two side and two rear fastening portions is mounted securely on the frame with the front portion of the strip on the front portion of the frame, each side portion of the strip on the front side portion and a first region of the rear fastening portion on the central side portion. A second end of the central side portion defines a bending edge along which a second region of the rear fastening portion is bent to fasten the strip to the frame.

15 Claims, 10 Drawing Sheets

DOOR SHELF FOR A REFRIGERATION DEVICE, REFRIGERATION DEVICE HAVING A DOOR SHELF AND METHOD FOR PROVIDING A DOOR SHELF

CROSS-REFERENCE TO RELATED APPLICATION

This application claims the priority, under 35 U.S.C. § 119, of German Patent Application DE 10 2017 216 288.0, filed Sep. 14, 2017; the prior application is herewith incorporated by reference in its entirety.

BACKGROUND OF THE INVENTION

Field of the Invention

The present invention relates to a door shelf for a refrigeration device and a refrigeration device having the door shelf. A refrigeration device is understood, in particular, to be a domestic refrigeration device, that is a refrigeration device which is used for domestic purposes in households or in the catering sector and serves, in particular, for storing foods and/or drinks at particular temperatures, for example a refrigerator, an upright freezer, a refrigerator-freezer or a chest freezer. The invention also relates to a method for providing a door shelf for a refrigeration device.

Refrigeration devices are known from the prior art in which shelves which serve for storing bottles, drinks and other refrigerated goods are mounted in the door of the refrigeration device and are also known as door shelves. Conventionally, both transparent and opaque door shelves are known which can have various decorative elements. Door shelves can be decorated, for example, with hot embossings, profiles, frames and the like. Those decorative elements are mostly mounted only on one side of the door shelf. However, there are also variants which are decorated on three sides of the door shelf.

A door shelf in which a metal band is mounted directly onto a base element is known from German Publication DE 10 2012 008 596 A1. However, with the configuration described in German Publication DE 10 2012 008 596 A1 for fixing the metal band on the base element, it can occur, for example due to manufacturing tolerances of the metal band, that the metal band does not lie completely tightly against the base element, so that inter alia the visual appearance of the door shelf is impaired.

SUMMARY OF THE INVENTION

It is accordingly an object of the invention to provide an improved door shelf for a refrigeration device, a refrigeration device having a door shelf and a method for providing a door shelf, which overcome the hereinafore-mentioned disadvantages of the heretofore-known shelves, devices and methods of this general type, in which the door shelf has a decorative strip, particularly made of metal and the decorative strip lies securely on the door shelf.

With the foregoing and other objects in view there is provided, in accordance with the invention, a door shelf for a refrigeration device, which comprises a dish-shaped base element, a support frame and a decorative strip. The dish-shaped base element is configured to be mounted on a door of the refrigeration device. The support frame is mounted on an upper end of the dish-shaped base element and includes a front portion and two side portions, and each side portion includes a front side portion, a central side portion and a rear side portion. The rear side portion is offset inwardly relative to the front side portion and the central side portion is connected at a first end to the front side portion. The decorative strip includes a front portion, two side portions and two rear fastening portions, the decorative strip is mounted on the support frame in such a way that the front portion of the decorative strip lies on the front portion of the support frame, each of the side portions of the decorative strip lies on the front side portion of the respective side portion of the support frame and a respective first region of the respective rear fastening portion of the decorative strip lies on the central side portion of the respective side portion of the support frame. A respective second end of the respective central side portion which lies opposite the respective first end defines a respective bending edge along which a respective second region of the respective rear fastening portion of the decorative strip is bent in order to fasten the decorative strip to the support frame.

Due to the bending of the second region of the rear fastening portion of the decorative strip along (or around) the bending line defined by the central side portion of the support frame, i.e. at least partially in the direction of the front portion of the decorative strip, in the door shelf according to the invention, the decorative strip is securely and reliably fastened to the support frame.

In an advantageous embodiment of the door shelf, the respective rear fastening portion includes a bending slit and/or one or more indentations. In this way, for example, the technical advantage is achieved that when the second region of the rear fastening portion is produced, the decorative strip can be bent more easily along the bending line defined by the central side portion of the support frame.

In a further advantageous embodiment of the door shelf, the respective second region of the respective rear fastening portion of the decorative strip extends in a first plane which is substantially perpendicular to a second plane in which the respective first region of the respective rear fastening portion of the decorative strip extends. In this way, for example, the technical advantage is achieved that, during production, the decorative strip can be fastened to the support frame without great effort.

In a further advantageous embodiment of the door shelf, the respective central side portion of the support frame defines a front side and a rear side, the respective first region of the respective rear fastening portion of the decorative strip lies on the front side of the central side portion of the support frame, and the bending edge is defined by an edge of the front side and a further bending edge is defined by the rear side, along which the respective second region of the respective rear fastening portion is bent in such a way that the second region lies at least partially on the rear side of the central side portion of the support frame. In this way, for example, the technical advantage is achieved that the decorative strip is fastened particularly securely and reliably to the support frame.

In a further advantageous embodiment of the door shelf, the respective second region of the respective rear fastening portion of the decorative strip extends in a first plane which extends offset substantially parallel to a second plane in which the respective first region of the respective rear fastening portion of the decorative strip extends, and the parallel offset between the first plane and the second plane preferably corresponds substantially to the thickness of the central side portion of the respective side portion of the support frame. In this way, for example, the technical advantage is achieved that the decorative strip is fastened particularly securely and reliably to the support frame.

In a further advantageous embodiment of the door shelf, the respective second region of the respective rear fastening portion of the decorative strip includes a further bending slit. In this way, for example, the technical advantage is achieved that when the second region of the rear fastening portion is produced, the decorative strip can be bent more easily along the bending line defined by the further bending slit.

In a further advantageous embodiment of the door shelf, the support frame includes a peripheral upper edging rib, the depth of which is at least as great as the thickness of the decorative strip. In this way, for example, the technical advantage is attained that the support frame ends flush with the decorative strip.

In a further advantageous embodiment of the door shelf, the front portion and/or the side portions of the support frame are coated at least partially with an adhesive layer which is disposed between the support frame and the decorative strip. In this way, for example, the technical advantage is achieved that during production, the decorative strip can be pre-fixed on the support frame by using the adhesive layer before the second region of the rear fastening portion of the decorative strip is bent around the central side portion of the support frame.

In a further advantageous embodiment of the door shelf, the respective rear fastening portion of the decorative strip defines a support edge and the respective central side portion of the support frame defines a placement rib on which the support edge of the respective rear fastening portion of the decorative strip lies. In this way, for example, the technical advantage is achieved that during production, the decorative strip can be pre-fixed on the support frame by using the placement rib before the second region of the rear fastening portion of the decorative strip is bent around the central side portion of the support frame.

In a further advantageous embodiment of the door shelf, the dish-shaped base element defines a respective placement edge on which the respective placement rib of the respective central side portion of the support frame lies.

In a further advantageous embodiment of the door shelf, the support frame is removably mounted on the upper end of the dish-shaped base element. In this way, for example, the technical advantage is attained that the dish-shaped base element and the support frame with the decorative strip fastened thereon can be cleaned separately from one another.

In a further advantageous embodiment of the door shelf, the support frame and the dish-shaped base element include at least one pair of latching elements, in particular latching projections and latching cut-outs to provide a latching connection. In this way, for example, the technical advantage is attained that the dish-shaped base element and the support frame with the decorative strip fastened thereon can easily be separated from one another and reassembled again.

In a further advantageous embodiment of the door shelf, the decorative strip is formed of metal and/or another elastically deformable material. The support frame and the dish-shaped base element can be formed of a plastics material.

With the objects of the invention in view, there is also provided a refrigeration device with a door shelf according to the invention. A refrigeration device is understood, in particular, to be a domestic refrigeration device, that is, a refrigeration device which is used for domestic purposes in households or in the catering sector and serves, in particular, for storing foods and/or drinks at particular temperatures, for example a refrigerator, an upright freezer, a refrigerator-freezer or a chest freezer.

With the objects of the invention in view, there is concomitantly provided a method for providing a door shelf for a refrigeration device. The method comprises the following steps:

applying a decorative strip which includes a front portion, two side portions and two rear fastening portions, on a support frame which defines a front portion and two side portions, each side portion includes a front side portion, a central side portion and a rear side portion, the rear side portion is offset inwardly relative to the front side portion and the central side portion includes a first end which is connected to the front side portion, so that the front portion of the decorative strip lies on the front portion of the support frame, each of the side portions of the decorative strip lies on the front side portion of the respective side portion of the support frame and a respective first region of the respective rear fastening portion of the decorative strip lies on the central side portion of the respective side portion of the support frame;

bending of a respective second region of the respective rear fastening portion of the decorative strip along a respective bending edge which is defined by a respective second end of the respective central side portion that lies opposite the respective first end, in order to fasten the decorative strip on the support frame; and mounting the support frame with the decorative strip fastened thereto on an upper end of a dish-shaped base element.

Other features which are considered as characteristic for the invention are set forth in the appended claims.

Although the invention is illustrated and described herein as embodied in a door shelf for a refrigeration device, a refrigeration device having a door shelf and a method for providing a door shelf, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
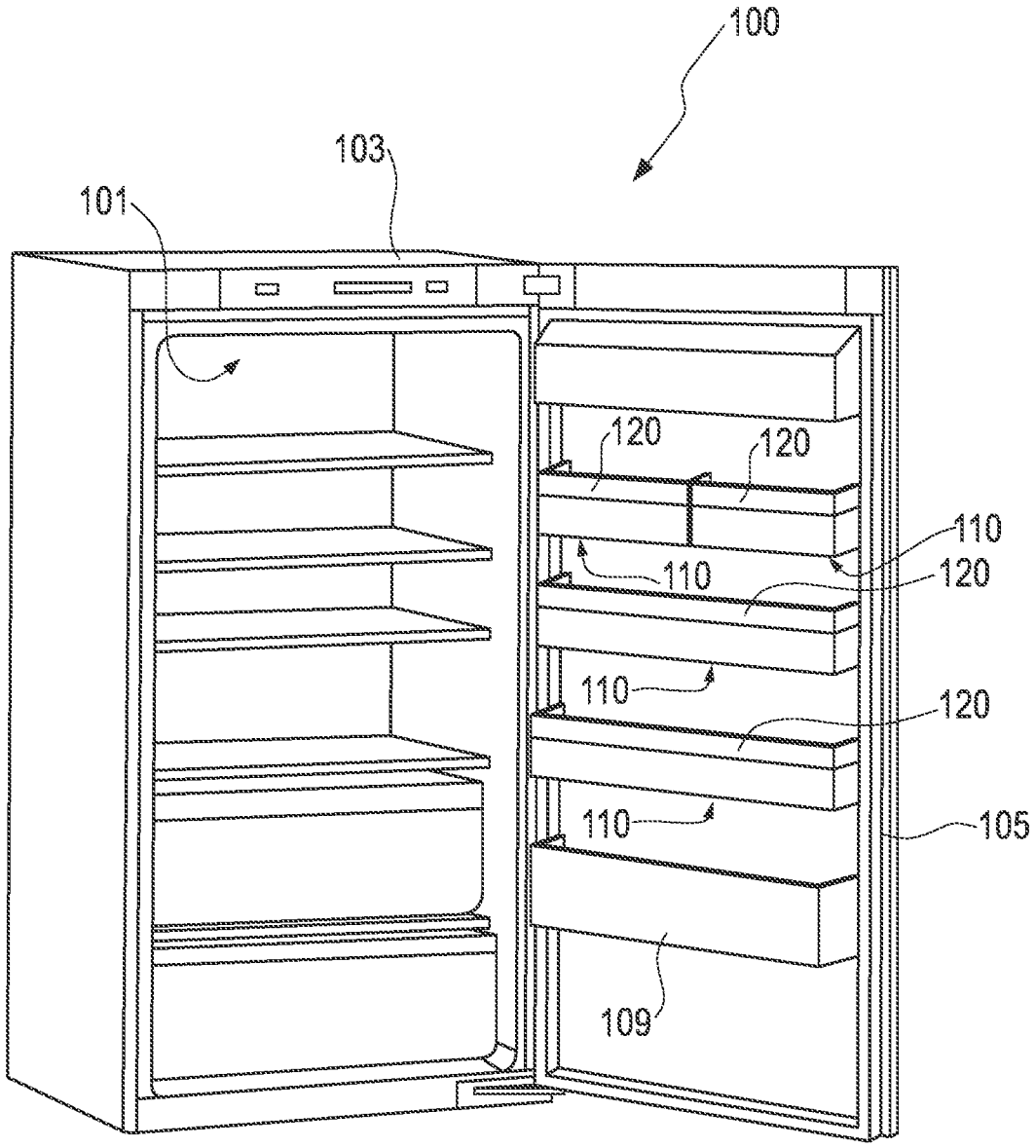
FIG. 1 is a diagrammatic, perspective view of a refrigeration device with a door shelf according to an embodiment of the invention.

Referring now to the figures of the drawings in detail and first, particularly, to FIG. 1 thereof, there is seen a refrigerator which is representative of a general refrigeration device 100 with a refrigeration device body 103 and a refrigeration device door 105 which is mounted on the refrigeration device body in order to be able to close a refrigeration chamber opening of a refrigeration device interior (or cooling chamber, for short) 101. The refrigeration device body 103 defines a refrigeration device outer wall and a cooling chamber wall. The cooling chamber wall includes a wall upper side, a wall rear side, a first wall longitudinal side, a second wall longitudinal side and a wall underside which delimit the cooling chamber 101 of the refrigeration device 100.

The refrigeration device 100 can include one or more refrigerant circuits, each with a refrigerant evaporator, a refrigerant compressor, a refrigerant condenser and/or a throttle element. The refrigerant evaporator is a heat exchanger in which, following the expansion, the liquid refrigerant is evaporated by heat absorption from the medium to be cooled, e.g. air. The refrigerant compressor is a mechanically driven component which draws refrigerant vapor from the refrigerant evaporator and outputs it at high pressure to the refrigerant condenser.

As FIG. 1 shows, a plurality of shelf elements for receiving cooled goods are disposed on the inside of the refrigeration device door 105 and in the exemplary embodiment of FIG. 1 the shelf elements include, apart from a conventional shelf element 109 without a decorative strip, at least one door shelf 110 with a decorative strip 120. As FIG. 1 shows diagrammatically, the door shelves 110 mounted on the refrigeration device door 105 are of different sizes.

Different embodiments of such a door shelf 110 represented in FIG. 1 will now be described making further reference to FIGS. 2 to 17.

Figure 2:
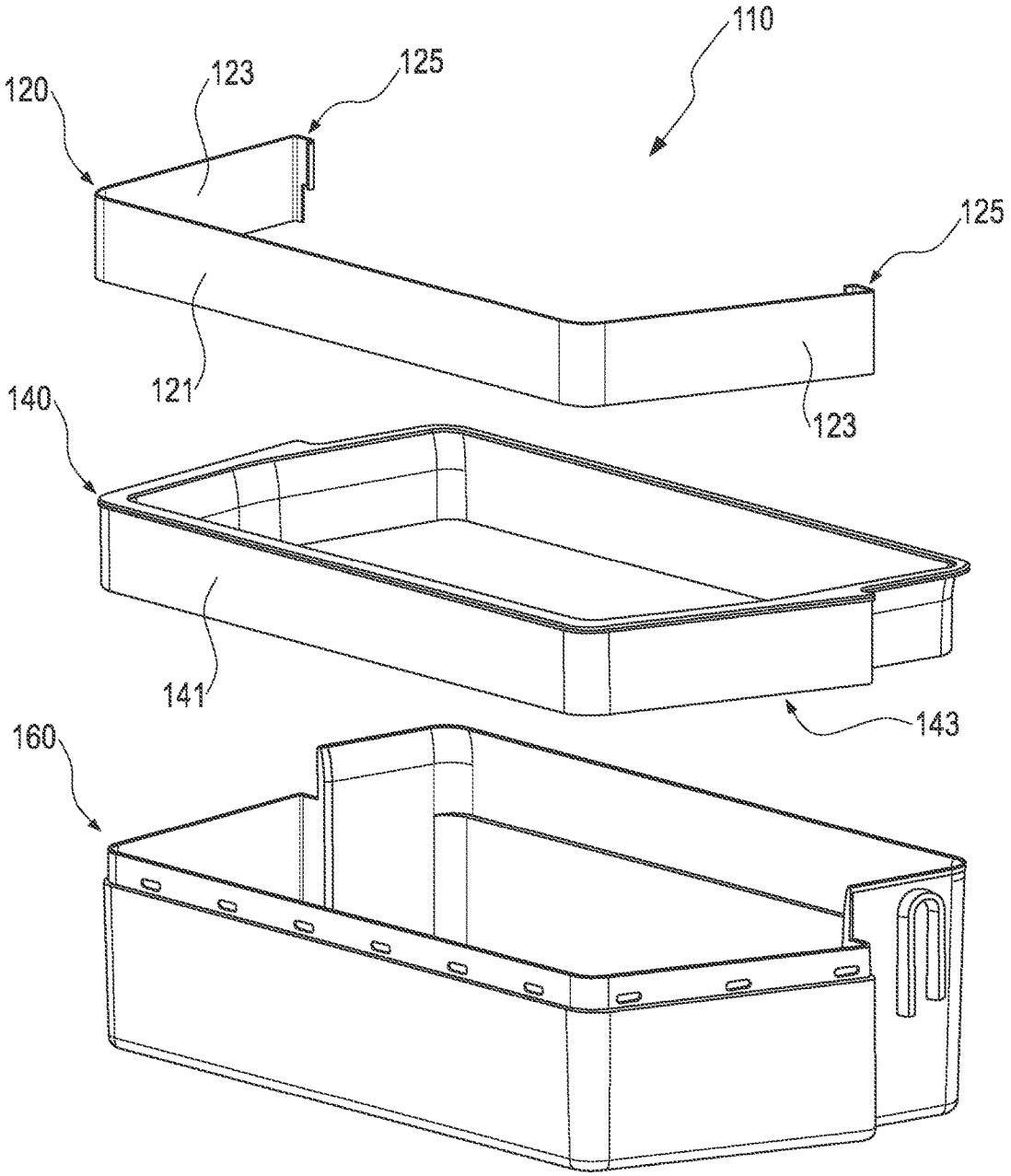
FIG. 2 is an exploded, perspective view of a door shelf according to an embodiment.
Figure 3:
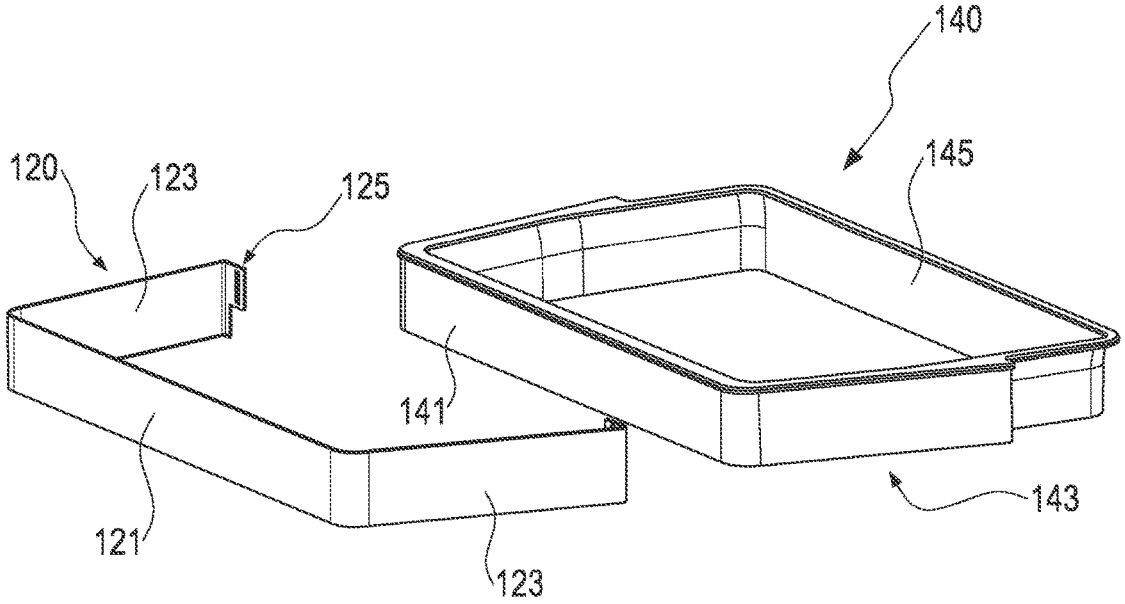
FIG. 3 is a perspective view of a decorative strip and a support frame of a door shelf according to an embodiment.
Figure 4:
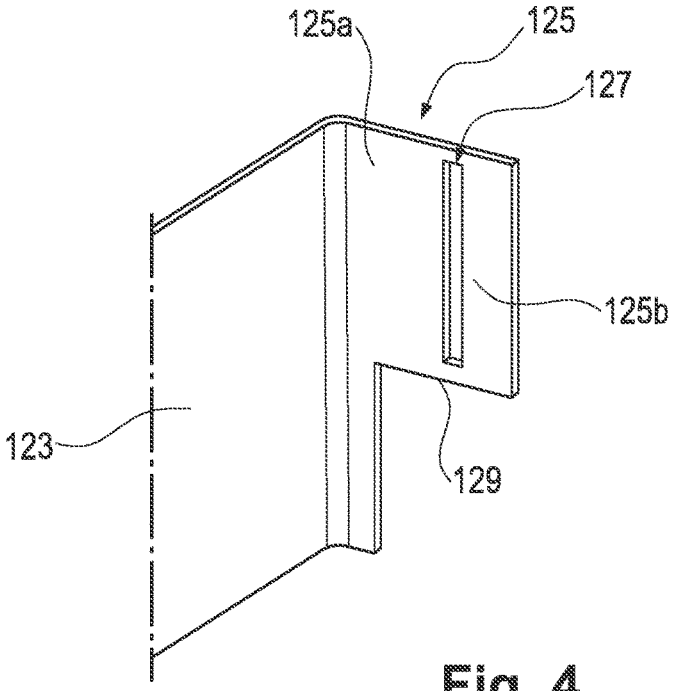
FIG. 4 is a fragmentary, perspective view of a fastening portion of a decorative strip of a door shelf according to an embodiment.

As can be seen, for example, from the exploded view of FIG. 2, the door shelf 110 includes, apart from the decorative strip 120, a dish-shaped base element 160 and a support frame 140. The decorative strip 120 preferably is formed of metal and/or another elastically deformable material. The support frame 140 and the dish-shaped base element 160 can be formed of a moldable plastics material.

The dish-shaped base element 160 is configured to be mounted on the door 105 of the refrigeration device 100. For this purpose, corresponding fastening grooves 163 can be provided in the rear region of the side walls of the dish-shaped base element 160. Through the use of the fastening grooves, the dish-shaped base element 160 and thus the door shelf 110 can be mounted on corresponding fastening elements in the door 105 of the refrigeration device 100.

The support frame 140 is mounted on an upper end of the dish-shaped base element 160 and includes a front portion 141 and two side portions 143. Since the two side portions 143 of the support frame 140 are configured symmetrically, in each case only one side portion is described in detail below. This also applies for the corresponding portions of the decorative strip 120 and of the dish-shaped base element 160. The side portion 143 of the support frame 140 includes a front side portion 143*a*, a central side portion 143*b* and a rear side portion 143*c* (see, for example, FIG. 5). The rear side portion 143*c* is offset inwardly relative to the front side portion 143*a*, i.e. the rear side portion 143*c* and the front side portion 143*a* form a step. A first end of the central side portion 143*b* is integrally bonded to the front side portion 143*a*. As shown, for example, in FIGS. 5 and 8 to 10, an intermediate space is provided between the opposite second end of the central side portion 143*b*, i.e. the end of the central side portion 143*b* facing away from the front side portion 1, and the rear side portion 143*c*, which as described in detail below enables the fastening of the decorative strip 120 to the support frame 140.

The decorative strip 120 includes a front portion 121, two side portions 123 and two rear fastening portions 125. The decorative strip 120 is mounted on the support frame 140 in such a way that the front portion 121 of the decorative strip 120 lies on the front portion 141 of the support frame 140, each of the side portions 123 of the decorative strip 120 lies on the front side portion 143*a* of the support frame 140 and a respective first region 125*a* (see, for example, FIG. 4) of the respective rear fastening portion 125 of the decorative strip 120 lies on the respective central side portion 143*b* of the support frame 140. According to one embodiment, the support frame 140 can be configured to be double-walled in its front region, i.e. in the region of the front portion 141 and of the front side portions 143*a* and single-walled in its rear region, i.e. in the region of the rear side portions 143*c* and of the rear portion 145.

Figure 7:
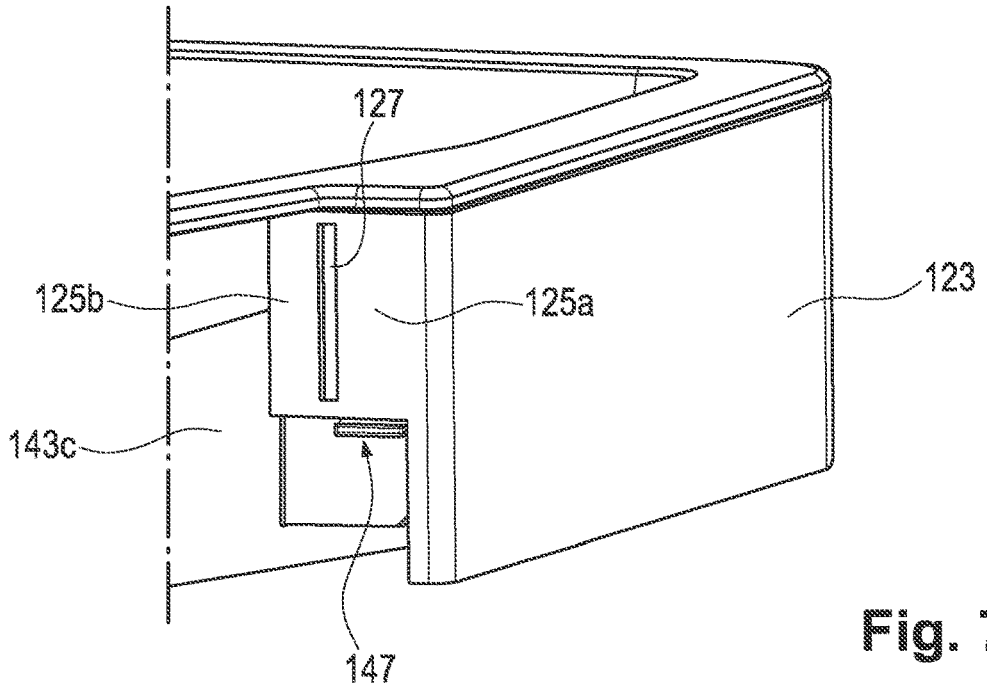
FIG. 7 is a fragmentary, perspective view of a decorative strip and of a support frame of a door shelf according to an embodiment.
Figure 8:
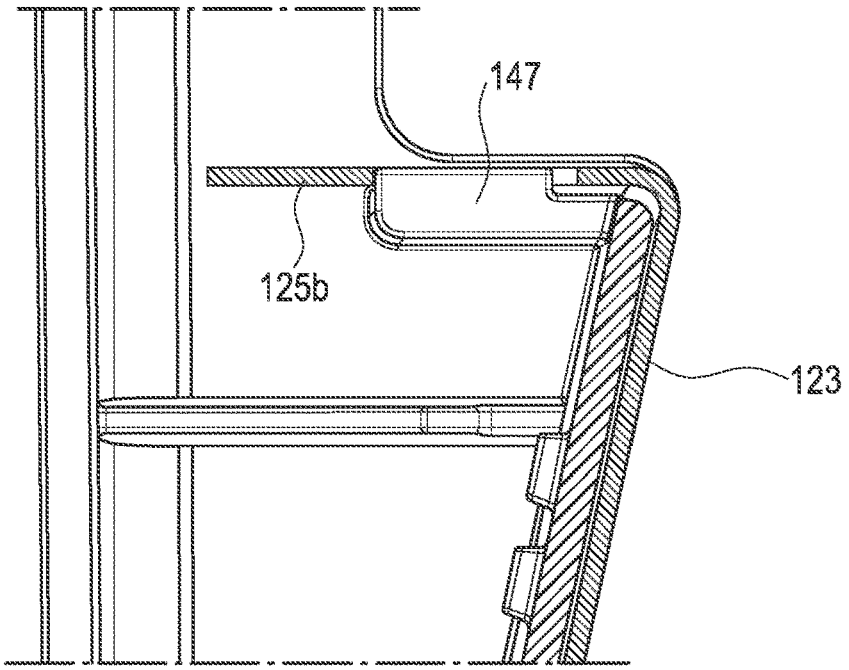
FIG. 8 is a fragmentary, sectional view of a decorative strip and of a support frame of a door shelf according to an embodiment.
Figure 9:
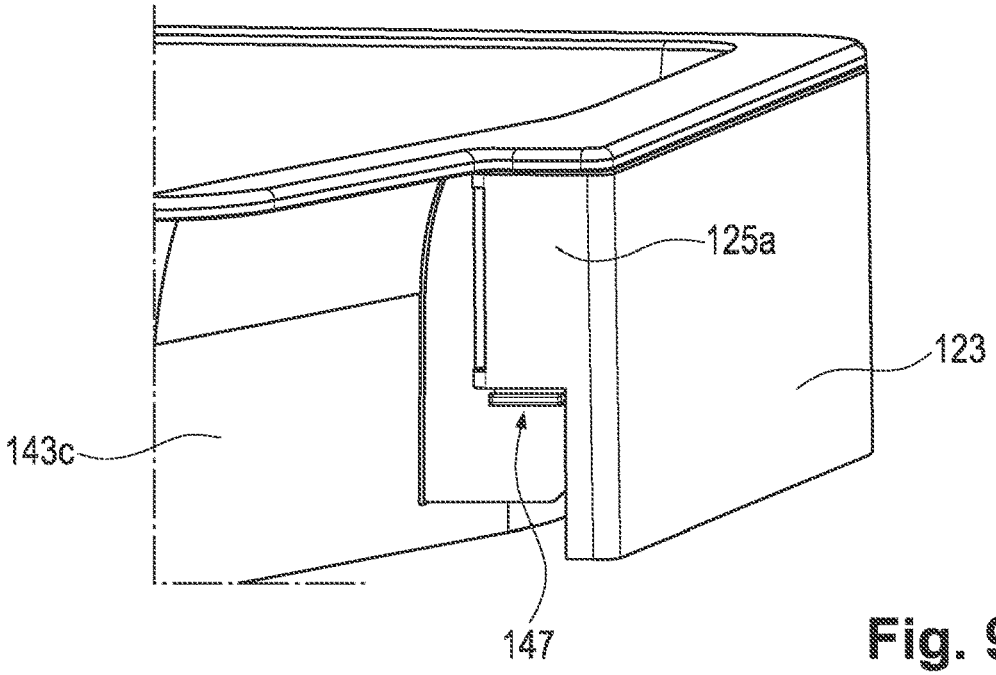
FIG. 9 is a fragmentary, perspective view of a decorative strip and of a support frame of a door shelf according to an embodiment.
Figure 10:
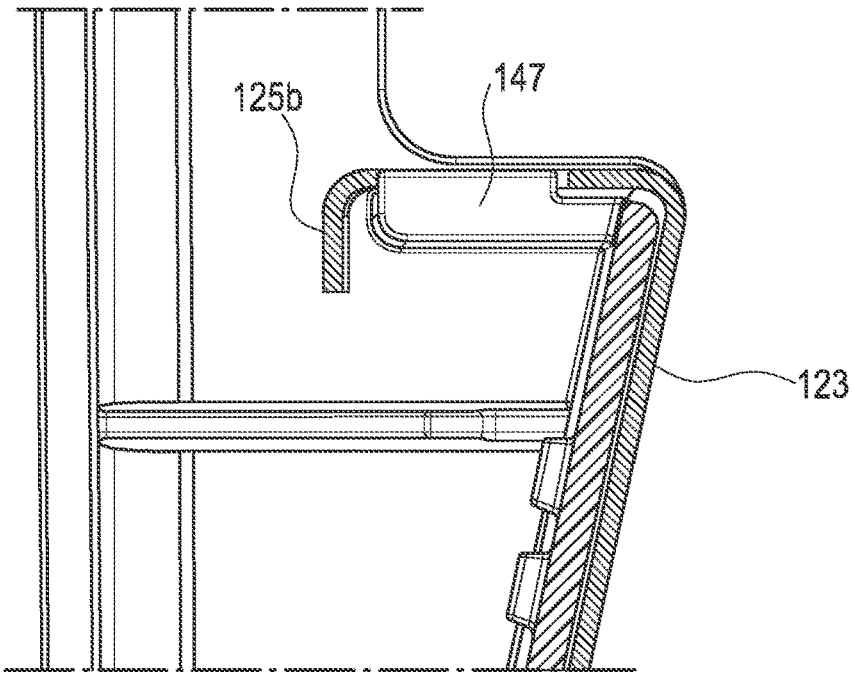
FIG. 10 is a fragmentary, sectional view of a decorative strip and of a support frame of a door shelf according to an embodiment.

The second end of the central side portion 143*b* facing away from the front side portion 143*a* defines a bending edge 144 (see FIG. 5) along which a second region 125*b* of the rear fastening portion 125 of the decorative strip 120 is bent in order to fasten the decorative strip 120 to the support frame 140. This inventive embodiment is illustrated in FIGS. 7 to 10, wherein FIGS. 7 and 8 show a perspective detail view of the support frame 140 and the decorative strip 120 before the bending of the second region 125*b* of the rear fastening portion 125 in the direction of the central side portion 143*b* and FIGS. 9 and 10 show a perspective detail view of the support frame 140 and of the decorative strip 120 after the bending of the second region 125*b* of the rear fastening portion 125 in the direction of the central side portion 143*b*. In order to facilitate this bending process, the rear fastening portion 125 can include a bending slit 127 and/or one or more indentations, as shown in particular, in FIGS. 4 and 7.

Figure 11:
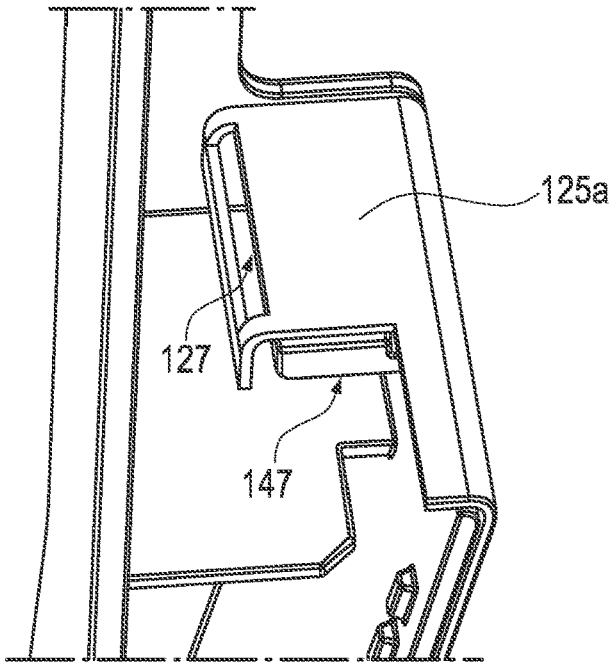
FIG. 11 is a fragmentary, perspective view of a decorative strip and of a support frame of a door shelf according to an embodiment.

FIGS. 10 and 11 show an embodiment in which, following the bending process, the second region 125*b* of the rear fastening portion 125 extends substantially at a right angle to the first region 125*a* thereof, i.e. the second region 125*b* extends in a first plane which lies substantially perpendicularly to a second plane in which the first region 125*a* of the rear fastening portion 125 of the decorative strip 120 extends.

Figure 12:
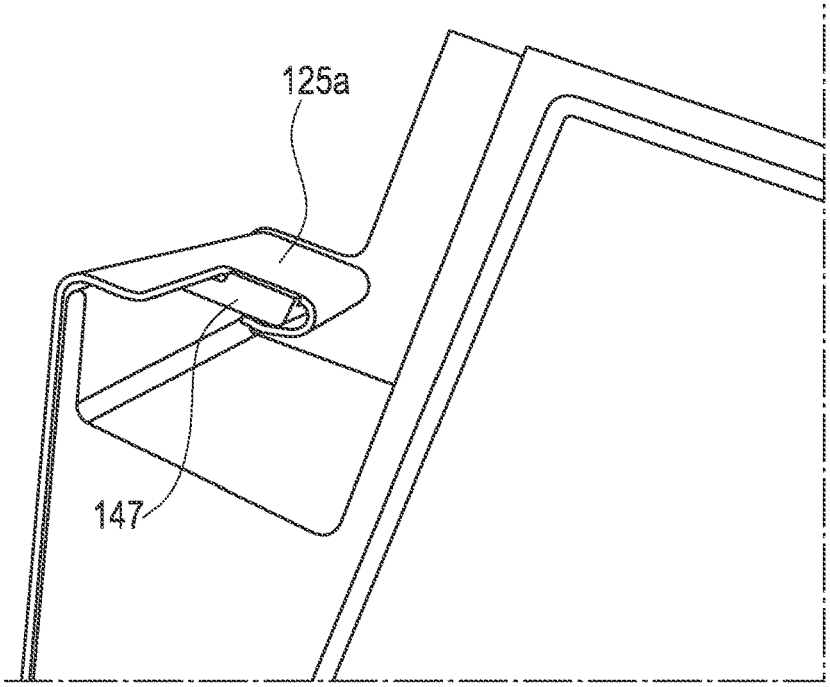
FIG. 12 is a fragmentary, perspective view of a decorative strip and of a support frame of a door shelf according to a further embodiment.
Figure 13:
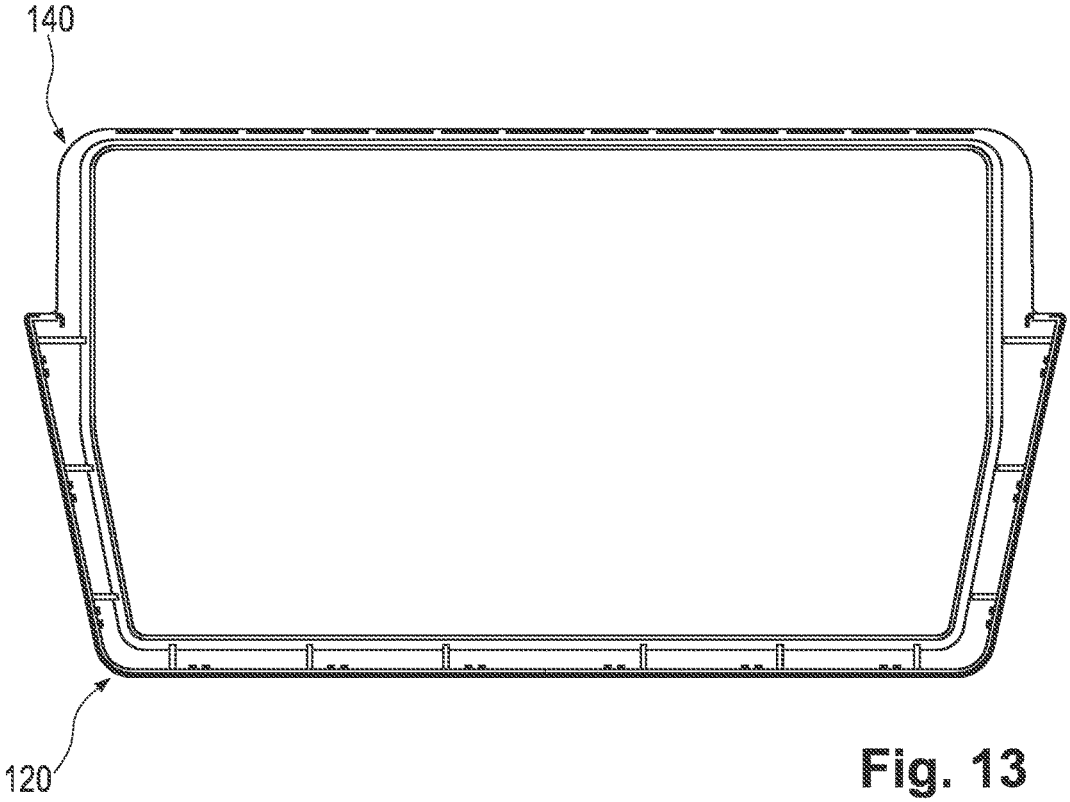
FIG. 13 is a plan view of a support frame and of a decorative strip mounted thereon of a door shelf according to an embodiment.

FIG. 12 shows an embodiment in which, following the bending process, the second region 125*b* of the rear fastening portion 125 extends substantially at an angle of 180° relative to the first region 125*a* thereof. In other words, the second region 125*b* of the rear fastening portion 125 of the decorative strip 120 extends in a first plane which extends offset substantially parallel to a second plane in which the first region 125*a* of the rear fastening portion 125 of the decorative strip 120 extends. In this case, the parallel offset between the first plane and the second plane preferably corresponds substantially to the thickness of the central side portion 143*b* of the support frame 140. Thus, in the embodiment shown in FIG. 12, the first region 125*a* of the rear fastening portion 125 of the decorative strip 120 lies on a front side of the central side portion 143*b* and the second region 125*b* lies at least partially on the corresponding rear side of the central side portion 143*b* of the support frame 140. In this embodiment, the bending edge 144 is defined by an edge of the front side of the central side portion 143*b* of the support frame and a further bending edge is defined by its rear side. According to one embodiment, a further bending slit and/or one or a plurality of indentations can be provided at a site corresponding to one of the further bending edges in the second region 125*b* of the rear fastening portion 125.

Figure 5:
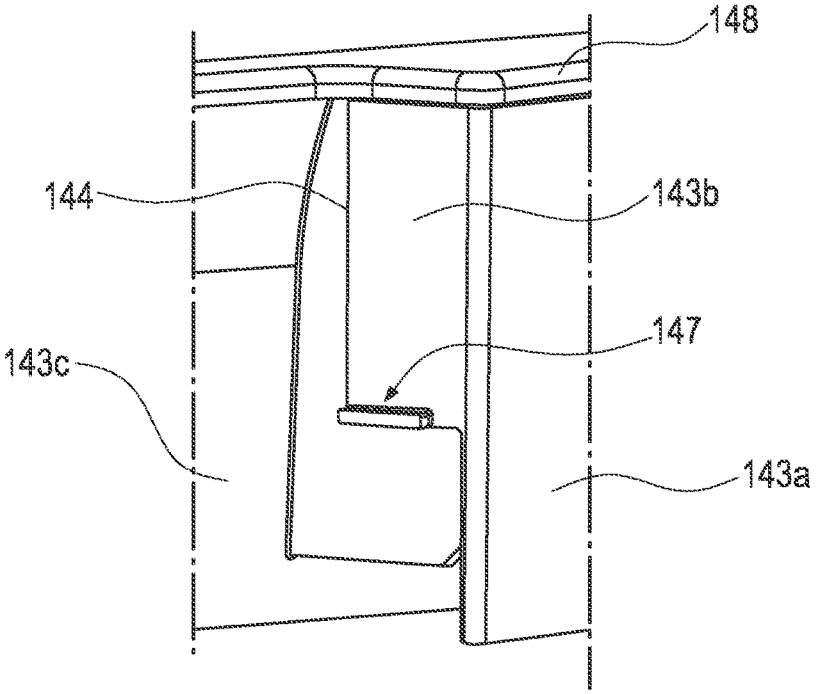
FIG. 5 is a fragmentary, perspective view of a central side portion of a support frame of a door shelf according to an embodiment.
Figure 6:
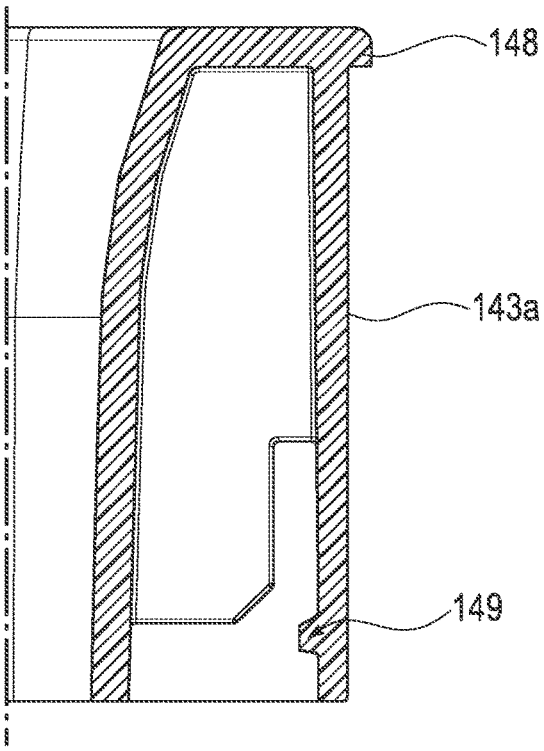
FIG. 6 is a fragmentary, sectional view of a support frame of a door shelf according to an embodiment.
Figure 14:
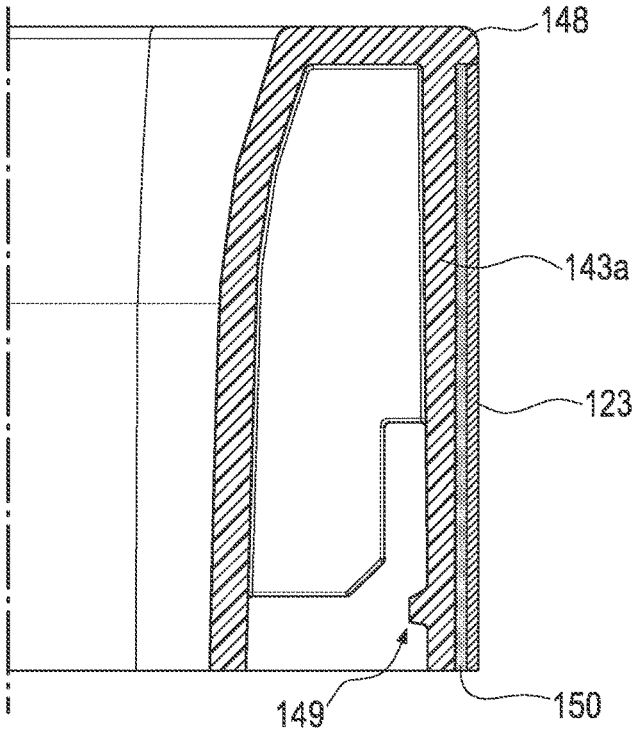
FIG. 14 is a fragmentary, sectional view of a decorative strip and of a support frame of a door shelf according to a further embodiment.
Figure 15:
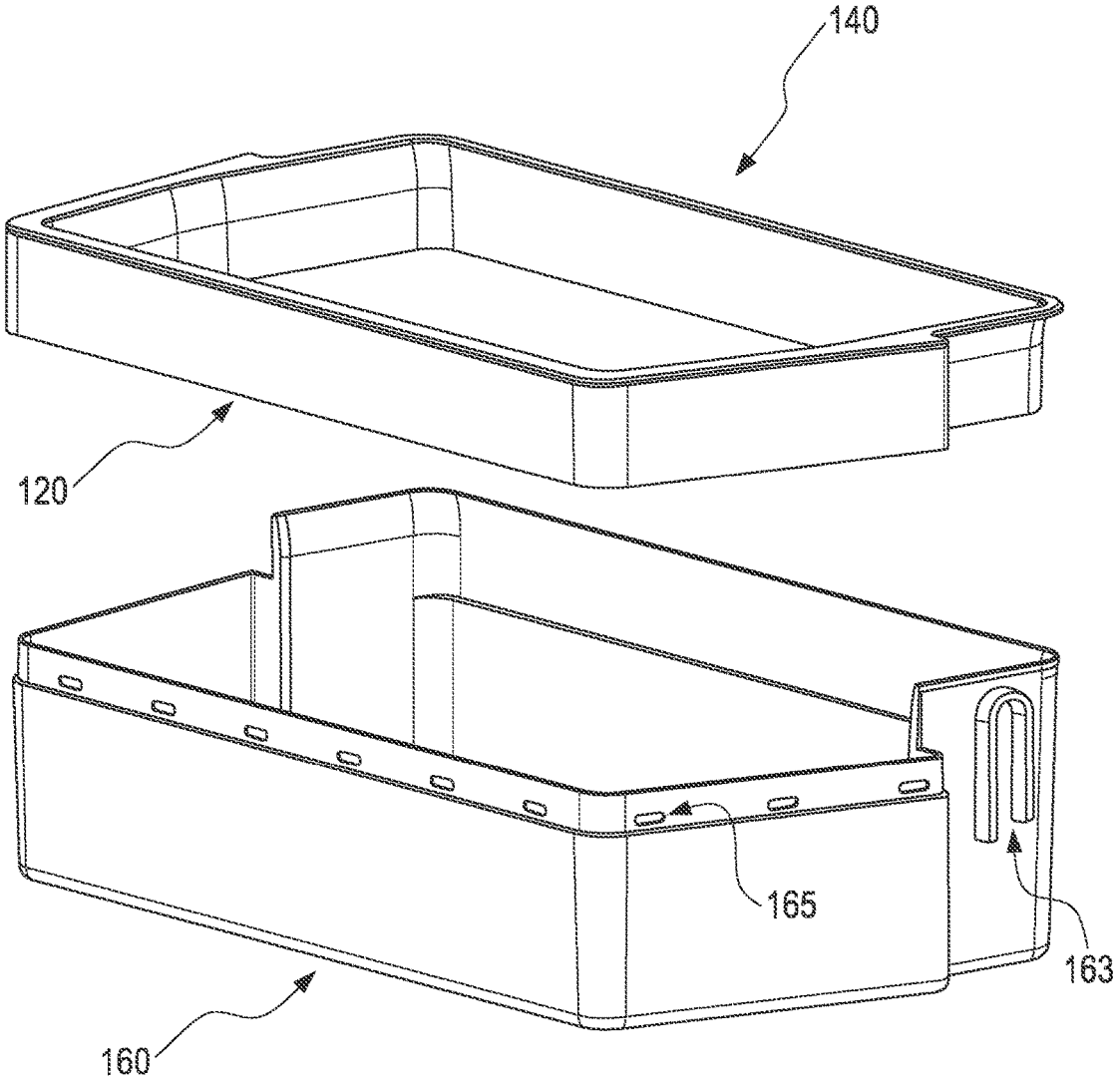
FIG. 15 is an exploded, perspective view of a door shelf according to an embodiment.
Figure 16:
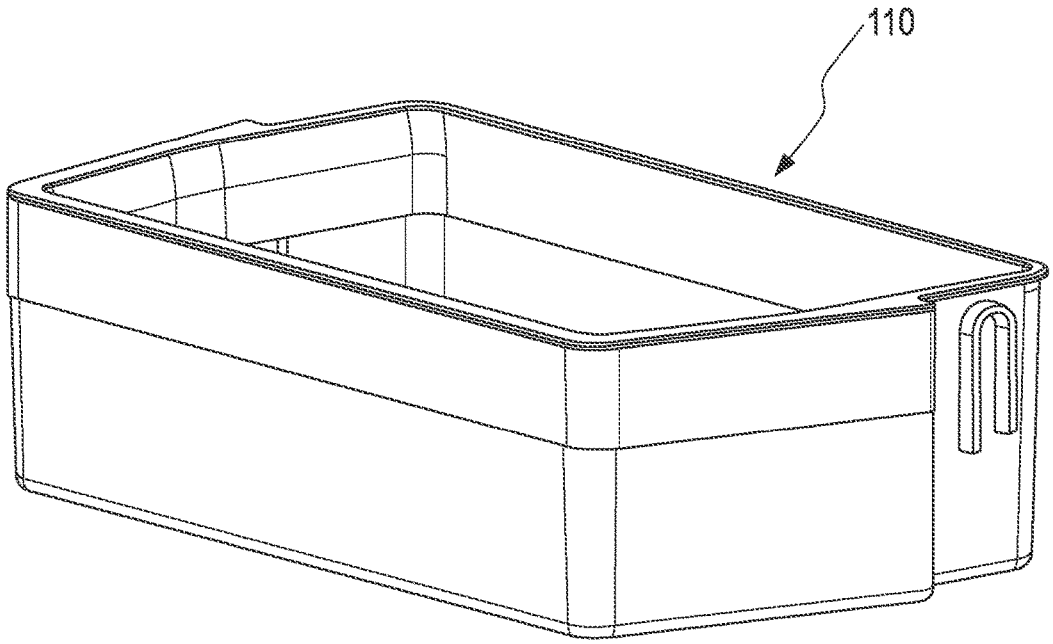
FIG. 16 is a perspective view of a door shelf according to an embodiment.

As FIGS. 5, 6 and 14 show, according to one embodiment, the support frame 140 can include a peripheral upper edging rib 148, the depth of which is at least as great as the thickness of the decorative strip. In this way, an edge of the decorative strip 120 is not visible from above and is protected. Through the use of the edging rib 148, gaps or deformations of the decorative strip 120 also arising can be concealed. As shown in the drawings, the decorative strip 120 is, for example, free at the lower edge of the front portion 141 of the support frame 140. According to a further embodiment, however, it is also possible to mount a rib, which covers the decorative strip 120 and protects it from beneath, on the lower edge of the support frame 140. This could possibly be configured only partially on the support frame 140. Such a lower rib can additionally serve to prevent the decorative strip 120 from slipping downwardly.

In order to pre-fix the decorative strip 120 relative to the support frame 140, according to one embodiment, the front portion 121 and/or the side portions 143 of the support frame 140 can be coated at least partially with an adhesive layer 150 which is disposed between the support frame 140 and the decorative strip 120 as shown in FIG. 14.

Figure 17:
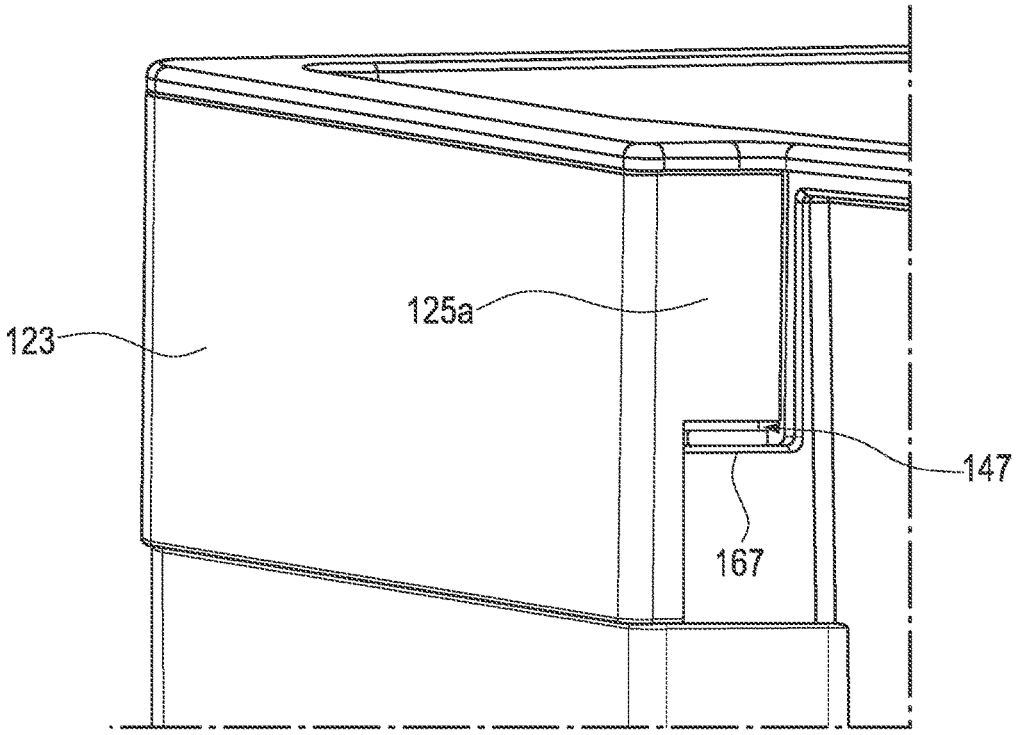
FIG. 17 is a fragmentary, perspective view of a decorative strip, of a support frame and of a base element of a door shelf according to an embodiment.

According to one embodiment, the rear fastening portion 125 of the decorative strip 120 defines a support edge 129 (see, for example, FIG. 4) and the central side portion 143*b* of the support frame 140 defines a correspondingly disposed placement rib 147 (see, for example, FIG. 5) on which the support edge 129 of the rear fastening portion 125 of the decorative strip 120 lies (see FIGS. 7 to 11). As shown in FIG. 17, according to one embodiment of the dish-shaped base element, a correspondingly disposed placement edge 167 can be defined on which the placement rib 147 of the central side portion 143*b* of the support frame 140 lies.

According to one embodiment, the support frame 140 is removably mounted on the upper end of the dish-shaped base element 160. For this purpose, the support frame 140 and the dish-shaped base element 160 can include at least a pair of latching elements, in particular a latching projection 149 and a corresponding latching cut-out 165 in order to form a latching connection (see FIGS. 2, 6 and 15). According to one embodiment, the rear portion 145 of the support frame 140 (see FIG. 15) can engage over the dish-shaped base element 160. In this region, hooks which engage over a rib on the dish-shaped base element 160 can be provided on the rear portion 145 of the support frame and fasten the support frame 160 thereon.

According to one embodiment, the door shelf 110 for the refrigeration device 100 can be manufactured by using a method which includes the following steps:

A first step is the mounting of the decorative strip 120 which includes the front portion 121, the two side portions 123 and the two rear fastening portions 125 on the support frame 140 which defines the front portion 141 and the two side portions 143, each side portion 143 including the front side portion 143*a*, the central side portion 143*b* and the rear side portion 143*c*, wherein the rear side portion 143*c* is offset inwardly relative to the front side portion 143*a* and the central side portion 143*b* includes the first end which is connected to the front side portion 143*a*, so that the front portion 121 of the decorative strip 120 lies on the front portion 141 of the support frame 140, each of the side portions 123 of the decorative strip 120 lying on the front side portion 143*a* of the respective side portion 143 of the support frame 140 and the respective first region 125*a* of the respective rear fastening portion 125 of the decorative strip 120 lying on the central side portion 143*b* of the respective side portion 143 of the support frame 140.

The decorative strip 120 is preferably bent forward according to the contour of the support frame 140. In this case, the ends of the decorative strip 120, i.e. the rear fastening portions 125 are bent inwardly. In this way, the decorative strip 120 can be pre-mounted on the support frame 140. Following the mounting, the decorative strip 120 extends continuously on the double-walled region of the support frame 140, i.e. on the front portion 141 and the front side portion 143*a* and ends laterally where the support frame 140 has an inward step, specifically at the central side portion 143*b*.

A second step is the bending of the respective second region 125*b* of the respective rear fastening portion 125 of the decorative strip 120 along the respective bending edge which is defined by the respective second end of the respective central side portion 143*b* which lies opposite the respective first end, in order to fasten the decorative strip 120 to the support frame 140.

Finally, a third step is the mounting of the support frame 140 with the decorative strip 120 fastened thereto on an upper end of the dish-shaped base element 160.

All of the features described and shown in conjunction with individual embodiments of the invention can be provided in different combinations in the subject matter according to the invention in order to simultaneously realize the advantageous effects thereof.

The scope of protection of the present invention is defined by the claims and is not restricted by the features disclosed in the description or shown in the drawings.

The following is a summary list of reference numerals and the corresponding structure used in the above description of the invention:

REFERENCE CHARACTERS

100 Refrigeration device
101 Cooling chamber
103 Refrigeration device body
105 Refrigeration device door
109 Shelf element
110 Door shelf
120 Decorative strip
121 Front portion
123 Side portion
125 Fastening portion
125*a* First region of the fastening portion
125*b* Second region of the fastening portion
127 Bending slit
129 Support edge
140 Support frame
141 Front portion
143 Side portion
143*a* Front side portion
143*b* Central side portion
143*c* Rear side portion
144 Bending edge
145 Rear portion
147 Placement rib
148 Edging rib
149 Latching projection
150 Adhesive layer
160 Base element
163 Fastening groove
165 Latching cut-out
167 Placement edge

The invention claimed is:

1. A door shelf for a refrigeration device, the door shelf comprising:

a dish-shaped base element configured to be mounted on a door of the refrigeration device, said dish-shaped base element having an upper end;

a support frame mounted on said upper end of said dish-shaped base element and defining a front portion and two side portions, each of said side portions including a front side portion, a central side portion and a rear side portion, said rear side portion being offset inwardly relative to said front side portion and said central side portion including a first end connected to said front side portion and a second end lying opposite to said first end and having a bending edge;

a decorative strip including a front portion, two side portions and two rear fastening portions each having first and second regions, said decorative strip being mounted on said support frame with said front portion of said decorative strip lying on said front portion of said support frame, and each of said side portions of said decorative strip lying on said front side portion of a respective one of said side portions of said support frame;

each of said first regions of a respective one of said rear fastening portions of said decorative strip lying on said central side portion of a respective one of said side portions of said support frame; and said second regions of said rear fastening portions of said decorative strip each being bent along a respective one of said bending edges to fasten said decorative strip to said support frame.

2. The door shelf according to claim 1, wherein each of said rear fastening portions has at least one of a respective bending slit or at least one respective indentation.

3. The door shelf according to claim 1, wherein:

each first region of a respective rear fastening portion of said decorative strip extends in a second plane; and each second region of said respective rear fastening portion of said decorative strip extends in a first plane lying substantially perpendicularly to said second plane.

4. The door shelf according to claim 1, wherein:

each central side portion of a respective side portion of said support frame defines a front side and a rear side;

said first region of a respective rear fastening portion of said decorative strip lies on said front side of said central side portion of a respective side portion of said support frame;

said bending edge is defined by an edge of said front side; and a further bending edge is defined by said rear side along which said respective second region of said respective rear fastening portion is bent, causing said second region to lie at least partially on said rear side of said central side portion of said respective side portion of said support frame.

5. The door shelf according to claim 4, wherein:

said first region of a respective rear fastening portion of said decorative strip extends in a second plane;

said second region of said respective rear fastening portion of said decorative strip extends in a first plane extending offset substantially parallel to said second plane; and a parallel offset between said first plane and said second plane corresponds substantially to a thickness of said central side portion of a respective side portion of said support frame.

6. The door shelf according to claim 1, wherein each second region of a respective rear fastening portion includes a further respective bending slit.

7. The door shelf according to claim 1, wherein said support frame includes a peripheral upper edging rib having a depth being at least as great as a thickness of said decorative strip.

8. The door shelf according to claim 1, wherein at least one of said front portion or said side portions of said support frame are at least partially coated with an adhesive layer disposed between said support frame and said decorative strip.

9. The door shelf according to claim 1, wherein:

each central side portion of a respective side portion of said support frame defines a placement rib; and each rear fastening portion of said decorative strip defines a support edge lying on a respective placement rib.

10. The door shelf according to claim 9, wherein said dish-shaped base element defines a respective placement edge on which said placement rib of a respective central side portion of said respective side portion of said support frame lies.

11. The door shelf according to claim 1, wherein said support frame is removably mounted on said upper end of said dish-shaped base element.

12. The door shelf according to claim 11, wherein said support frame and said dish-shaped base element include at least one pair of latching elements to form a latching connection.

13. The door shelf according to claim 1, wherein said decorative strip is formed of at least one of metal or another elastically deformable material.

14. A refrigeration device, comprising at least one door shelf according to claim 1 for receiving cooled goods.

15. A method for providing a door shelf for a refrigeration device, the method comprising the following steps:

providing a decorative strip including a front portion, two side portions and two rear fastening portions each having first and second regions;

providing a support frame defining a front portion and two side portions, each side portion including a front side portion, a central side portion and a rear side portion, the rear side portion being inwardly offset relative to the front side portion and the central side portion including a first end connected to the front side portion and a second end lying opposite to the first end and having a bending edge;

providing a dish-shaped base element having an upper end;

mounting the decorative strip on the support frame with the front portion of the decorative strip lying on the front portion of the support frame, each of the side portions of the decorative strip lying on the front side portion of a respective side portion of the support frame and a respective first region of a respective rear fastening portion of the decorative strip lying on the central side portion of a respective side portion of the support frame;

bending a respective second region of the respective rear fastening portion of the decorative strip along a respective bending edge to fasten the decorative strip to the support frame; and mounting the support frame with the decorative strip fastened thereto on the upper end of the dish-shaped base element.

* * * * *